US006257631B1

(12) United States Patent
Sokurenko et al.

(10) Patent No.: US 6,257,631 B1
(45) Date of Patent: Jul. 10, 2001

(54) DRAW LATCH

(75) Inventors: William E. Sokurenko, Glenolden; Eric D. Hyp, Aspers; Eli J. Holtman, Narberth, all of PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/351,064

(22) Filed: Jul. 9, 1999

Related U.S. Application Data

(60) Provisional application No. 60/095,151, filed on Aug. 3, 1998, and provisional application No. 60/093,115, filed on Jul. 16, 1998.

(51) Int. Cl.[7] ..... E05C 5/00

(52) U.S. Cl. ..... 292/247; 292/DIG. 49

(58) Field of Search ..... 292/247, 113, 292/256, 69, 263, DIG. 49; 24/71 SK

(56) References Cited

U.S. PATENT DOCUMENTS

| | | | | |
|---|---|---|---|---|
| D. 324,165 | | 2/1992 | Bressler et al. | D8/331 |
| D. 343,782 | | 2/1994 | Gromotka et al. | D8/331 |
| D. 371,953 | | 7/1996 | Ford et al. | D8/330 |
| D. 377,446 | | 1/1997 | Ford et al. | D8/330 |
| 1,184,439 | | 5/1916 | Giles . | |
| 3,466,076 | | 9/1969 | Frame et al. | 292/109 |
| 3,479,701 | * | 11/1969 | Zefoss | 292/66 |
| 3,630,559 | | 12/1971 | Rawson | 292/113 |
| 3,847,423 | * | 11/1974 | Gley | 292/113 |
| 3,892,434 | * | 7/1975 | Caldwell | 292/247 |
| 4,023,839 | | 5/1977 | Bisbing | 292/85 |
| 4,023,840 | * | 5/1977 | Souza | 292/113 |
| 4,230,351 | | 10/1980 | Bisbing | 292/223 |
| 4,422,689 | * | 12/1983 | Yamamoto | 296/224 |
| 4,540,206 | | 9/1985 | Frame et al. | 292/66 |
| 4,627,650 | * | 12/1986 | Hauschulte | 292/113 |
| 4,687,237 | | 8/1987 | Bisbing | 292/78 |
| 4,705,308 | * | 11/1987 | Bisbing | 292/108 |
| 4,804,215 | | 2/1989 | Bisbing | 292/113 |
| 4,828,298 | | 5/1989 | Bisbing | 292/113 |
| 4,830,413 | | 5/1989 | Bisbing | 292/247 |
| 4,890,869 | | 1/1990 | Langkamp, Jr. | 292/113 |
| 5,024,471 | * | 6/1991 | Kahl | 292/97 |
| 5,127,684 | * | 7/1992 | Klotz | 292/113 |
| 5,271,649 | | 12/1993 | Gromotka | 292/113 |
| 5,478,125 | | 12/1995 | Gromotka | 292/67 |
| 5,607,195 | | 3/1997 | Antonucci | 292/247 |
| 5,626,373 | * | 5/1997 | Chambers | 292/113 |
| 5,655,799 | * | 8/1997 | Takimoto | 292/113 |
| 5,742,990 | | 4/1998 | Antonucci | 29/434 |
| 6,032,988 | * | 3/2000 | Klein | 292/247 |

OTHER PUBLICATIONS

Southco, Inc. Handbook #48, pp. H11–H26.

* cited by examiner

*Primary Examiner*—B. Dayoan
*Assistant Examiner*—Gary Estremsky
(74) *Attorney, Agent, or Firm*—Paul & Paul

(57) ABSTRACT

A draw latch for securing a first closure panel with a second closure panel, having a base mounted to one of the closure panels, a cover member and a pivot member, the pivot member connecting said base with said cover member, there being a matingly provided keeper member which is mounted on the other closure panel to secure the cover for latching, the draw latch pivot member, base and cover being configured to facilitate installation of the pivot member thereto.

9 Claims, 6 Drawing Sheets

DRAW LATCH

CROSS-REFERENCE TO RELATED APPLICATIONS

This application claims priority from U.S. provisional application Ser. No. 60/095,151, filed on Aug. 3, 1998, and U.S. Provisional Application Serial No. 60/093,115, filed on Jul. 16, 1998.

BACKGROUND OF THE INVENTION

1. Field of the Invention

This invention relates to latches, and more particularly, to draw latches for latching together two closure members.

2. Background of the Invention

The present latch is referred to as a "draw latch" because it forcibly draws together the two closure members on which the latch members are mounted. Such members may be components of a cabinet, or a case, or a housing for a machine, a window or door panel, or any type of enclosure. In many cases, the closure members will be co-planar panels, but, in other cases, the two closure members will be angularly disposed, such as at right angles to each other.

All draw latches are basically toggle devices having three links and three pivot points. One of the pivot points is disengageable so that the latch may be unlatched to separate the closure members.

The present invention relates particularly to a draw latch of the toggle type which is sturdy and has improved retention and assembly features.

The prior art has provided draw latches of the toggle type with means for adjusting the distance between latching points. Some prior art adjustable latches incorporate a screw thread in the link which is to be stressed in tension. This introduces an undesirable feature, namely, if the latch be loaded beyond its maximum holding strength, there would be a complete failure of the latch mechanism.

Also in some prior art draw latches, the threaded tension link is the detachable link and is articulated with the handle lever in such manner that the latching operation involves two motions: (1) engagement of the detached link with its cooperating element and (2) the lever action to close the latch. Depending on the orientation of the latch with respect to gravity or other outside forces, the latching operation may require two hands.

Another deficiency of prior art adjustable draw latches resides in the complexity of the mechanism due to the attachment of the link. Usually rivets and cross pins are required to provide the pivoting joint.

A further disadvantage of prior art draw latches is the generally unpleasing appearance of the device. Due to the geometry of the articulated members, the mounting hardware and other aesthetically objectionable features which are exposed for viewing.

One example of a draw latch which is provided to overcome these aforementioned deficiencies, is disclosed in U.S. Pat. No. 4,540,206, issued on Sep. 10, 1985 and assigned to Southco, Inc. the complete disclosure of which is herein incorporated by reference.

SUMMARY OF THE INVENTION

A draw latch is provided with a base and a cover member which are connected by a pivot member which permits relative rotation of the base and cover. A keeper member is provided for mounting to a first closure member, such as a window frame, and is configured to be engaged by the cover selectively by the user, when the latch is secured.

Preferably, the pivot member is provided as a single element which can be matingly configured for installation into the base, and the base cooperatingly configured to retain a part of the pivot member. The cover, likewise, is configured to connect with an opposite portion of the pivot member. One or more orienting elements is provided on the pivot member to facilitate installation on the base and cover in the appropriate positions.

Stops are provided to regulate the swing of the cover and pivot member relative to the base.

A principal object of the present invention is to provide an improved draw latch of the toggle action type.

A more specific object is to provide a draw latch of the toggle action type which includes orienting elements to facilitate assembly and operation of the latch.

Another object is to provide such a draw latch having a simplified design for economical manufacture and assembly.

Another object is to provide a latch which may be engaged and latched in a single motion.

Another object is to provide a draw latch of the toggle action type which is of more pleasing appearance.

Another object is to provide a draw latch which has improved retention and stability characteristics. Another object is to provide a draw latch which has improved assembly features.

Another object is to provide a draw latch in which the tension link is a larger member of the assembly which covers and conceals the other components when in latch position, thereby providing a stylish uncluttered appearance and free of hazardous protruding elements.

Yet another object is to provide a draw latch of the foregoing type in which at least some, or all, of the components are molded of engineering plastic resin, thereby to provide a latch that is entirely resistant to corrosion and is nonmagnetic.

DETAILED DESCRIPTION OF THE PREFERRED EMBODIMENTS

Figure 1:
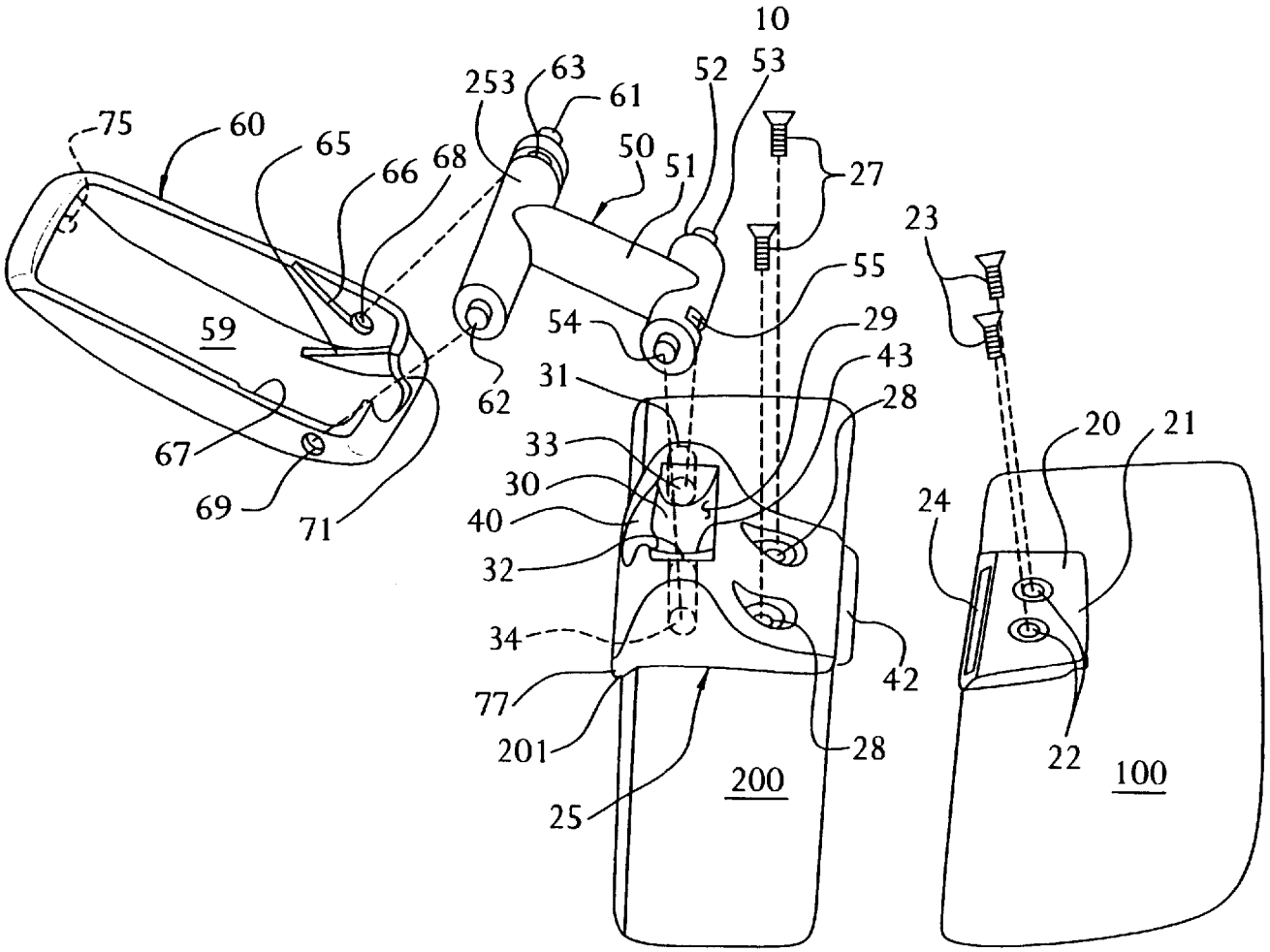
FIG. 1 is an exploded perspective view showing the components of the improved draw latch according to the present invention.

FIG. 1 is an exploded view showing in perspective the various components of the draw latch 10 of the present invention. Reference numeral 20 identifies a keeper having a lip 21, and apertures 22 for securing the keeper 20 to a first closure member, generally 100, with fastening members, such as, for example, the screws 23. The keeper 20 also includes a transverse slot 24 provided on the keeper side opposite that of the lip 21.

Reference numeral 25 identifies a base member or bracket which is secured to a second closure member, generally, 200, with mounting screws 27 extending through the apertures 28 provided in the base member 25. The base member or bracket 25 is provided with a central opening 29 which is defined by a radially configured surface 30. Guide slots 31, 32 are provided on opposite axial ends of the central opening 29. Preferably, the guide slots 31, 32 are tapered to provide a wider dimension at their upper-most point and tapering to a smaller dimension at their lower-most point. A pair of receiving apertures 33, 34 is provided, each being disposed on opposite sides of the central opening 29 and located immediately below the slots, respectively, 31, 32. The base 25 further includes a notch 40 disposed in the rear thereof.

Figure 7:
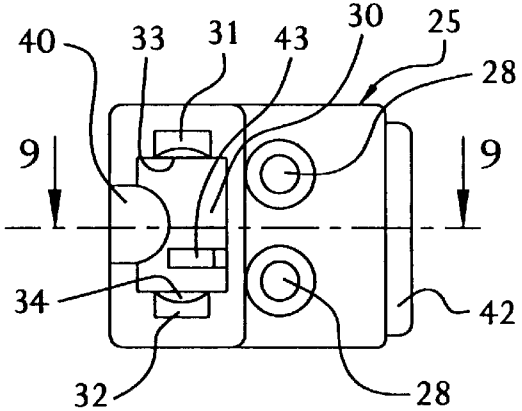
FIG. 7 is a top plan view of the base member of the draw latch according to the present invention.

The draw latch 10 further includes aligning means, provided to facilitate aligning of the latch components during assembly and during latching and unlatching of the device 10. The latching aligning means is shown comprising a tab portion 42 extending from the base member 25. The tab portion 42 is provided to be received in the transverse receiving slot 24 of the keeper 20 when closure panels, such as those 100 and 200, are brought together to be secured with the latch 10. The assembling aligning means is shown comprising an annular ridge 43 which is disposed along the surface 30 of the central opening 29. This is best shown in FIG. 1, and in the top view of FIG. 7. The annular ridge 43 is provided in offset relation to the center line (see line 9—9 of FIG. 7) of the central opening 29 to (comprise a positioning and orienting means for positioning and orienting a pivot member 50.

The pivot member 50 is shown comprising a central shaft 51 with a base mounting portion 52 provided at one end thereof and a cover mounting portion 253 provided on the opposite end thereof. The base mounting portion 52 is shown including a pivot boss 53, 54 disposed at each axial end of the base mounting portion 52. An annular groove 55 is disposed on the base mounting portion 52 of the pivot member 50 at a location corresponding to the location of the annular ridge member 43 of the base 25, such that when the base mounting portion 52 of the pivot member 50 is installed on the base 25, the pivot member 50 is oriented in only a single position. Preferably, installation is accomplished by inserting the base mounting portion 52 of the pivot member 50 into the central opening 29 by guiding the pivot bosses 53, 54 respectively, into the guide slots 31, 32, and snapping them into position within the respective retaining apertures 33, 34.

The pivot member 50, when mounted to the base 25, as described, is permitted to pivot thereabout. The notch 40 of the base 25 permits extension of the pivot range of the pivot member 50 by accommodating the central shaft 51 of the pivot member 50 therein for the rearward most pivot position (i.e. fully open).

A cover 60 is provided to be received on the cover mounting portion 253 of the pivot member 50, in a manner similar to the base mounting portion 52, as described above. The cover mounting portion 253 is provided with a pair of outwardly extending pivot bosses 61, 62. Aligning and orienting means is provided to facilitate alignment and orienting of the cover 60 relative to the pivot member 50. The aligning and orienting means is shown comprising an annular groove 63 disposed in the cover mounting portion 253 of the pivot member 50, and a corresponding ridge member 65 disposed on the interior surface 59 of the cover 60. This alignment and orienting means ensures that the cover 60 will be installed facing the proper direction for engagement with the keeper 20. The cover 60 further comprises installation facilitating means including a pair of tapered slots 66, 67 into which the pivot bosses, respectively, 61, 62 of the cover mounting portion 253 are inserted. The pivot bosses 61, 62 are guided along the respective guide slots 66, 67 until reaching the respective retaining apertures 68, 69, into which the pivot bosses 61, 62, are inserted for installation. Preferably the pivot bosses 61, 62 are snap fit into the respective retaining apertures 68, 69. The cover 60 further includes a slot 71 disposed therein in the rear portion thereof. The cover slot 71 is provided to receive the central shaft 51 of the pivot member 50 therein to provide an extended range of pivot for the cover 60 with respect to the pivot member 50.

Figure 3:
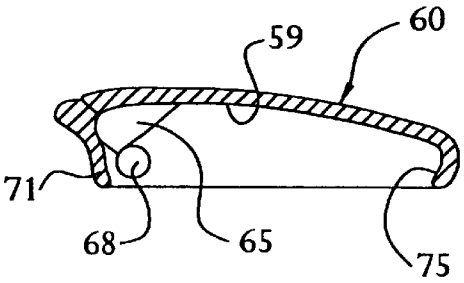
FIG. 3 is a longitudinal cross-sectional view of the cover.
Figure 5:
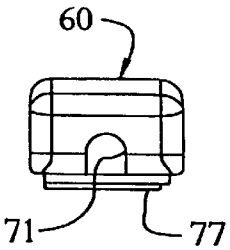
FIG. 5 is a rear view of the latch shown in FIG. 4.
Figure 2:
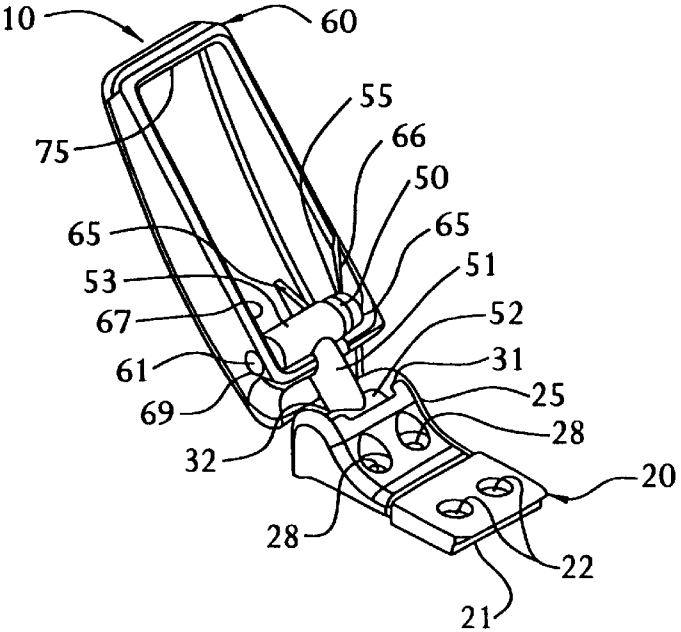
FIG. 2 is a parallel perspective view showing the draw latch in its assembled condition with the cover unlatched from the keeper.
Figure 4:
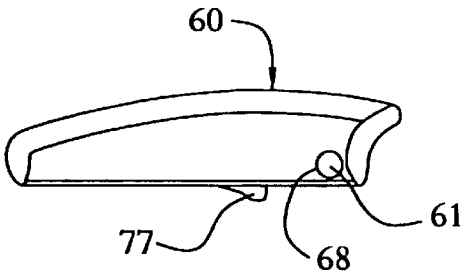
FIG. 4 is a side elevation view of the draw latch according to the present invention, shown in its latched position with the cover closed over the keeper member.

FIG. 2 shows the latch 10 in its assembled condition. Preferably, the cover 60 further includes a retaining ridge portion 75 which is configured to engage the lip 21 of the keeper 20 to facilitate latching of the assembly 10. As shown in the cross-sectional view of the cover 60 in FIG. 3, the retaining ridge 75 comprises an in-turned configuration which is received over the lip 21 of the keeper 20 when the cover 60 is latched to engage the keeper 20.

The latch 10 is further shown with contouring means for facilitating the installation of the base member 25 to a mounting surface, such as that 200 shown in FIG. 1. The contouring means preferably comprises a transverse ridge portion 77 provided along the bottom of the base 25. The ridge portion 77 engages an edge 201 of the panel 200 to facilitate retention of the assembly 10 and to maintain stability of the assembly 10 when installed and operated.

Figure 6:
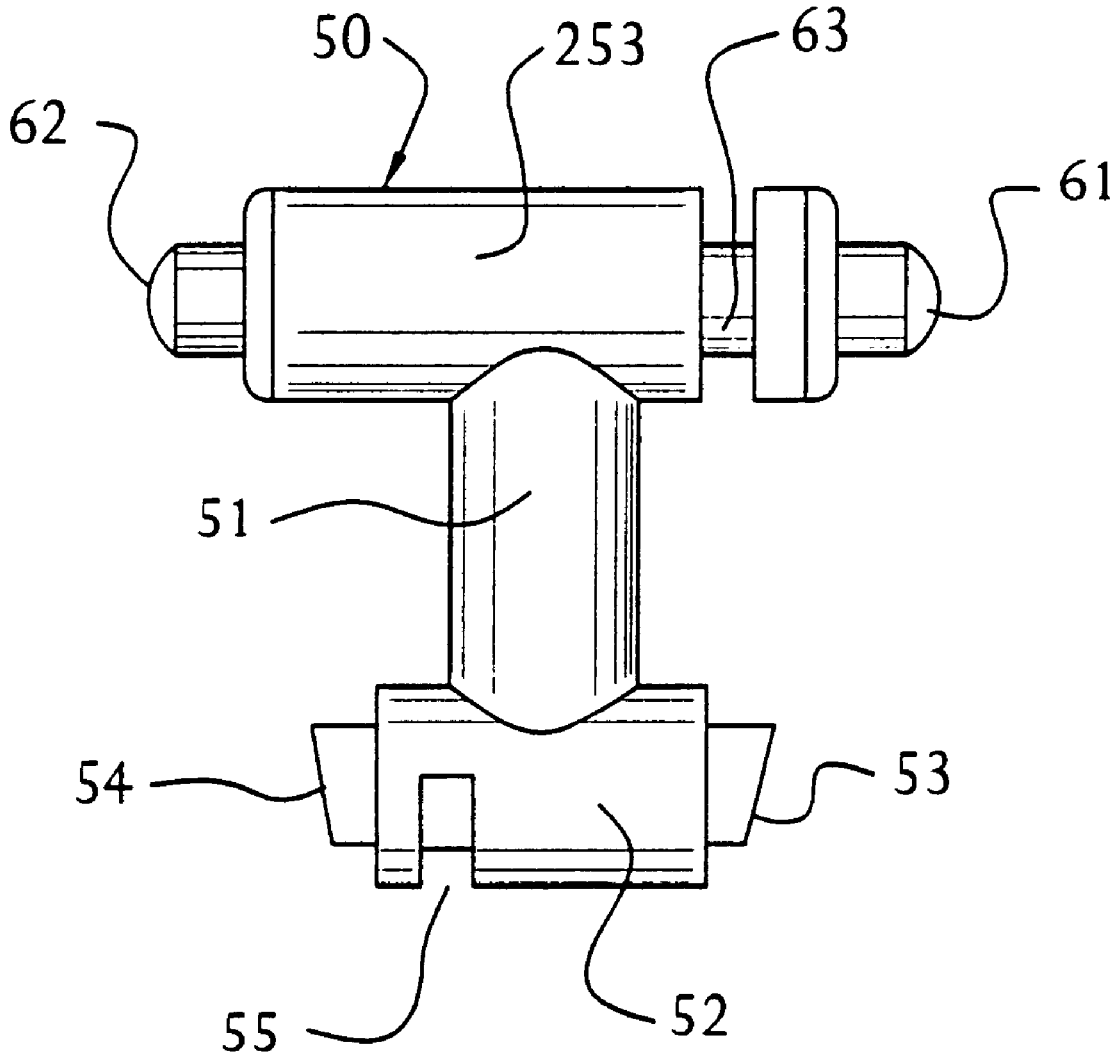
FIG. 6 is a front elevation view of the pivot member of the draw latch shown in FIGS. 1 through 5.
Figure 9:
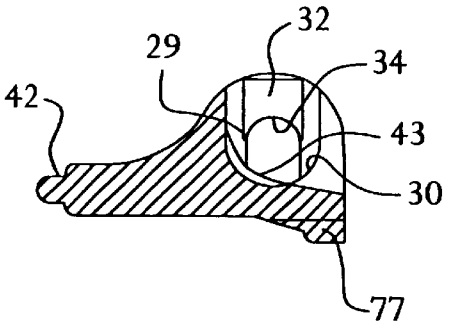
FIG. 9 is a cross-sectional view of the base member of the draw latch according to the present invention, taken along the line 9—9 of FIG. 7.
Figure 8:
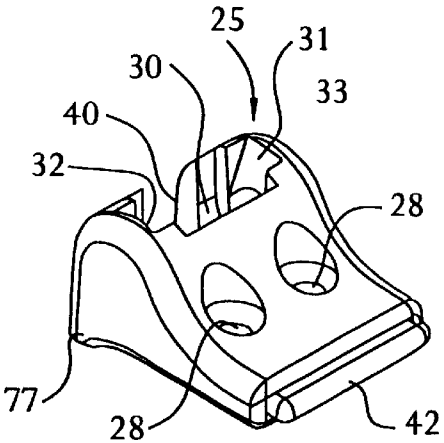
FIG. 8 is a parallel perspective view of the base member of the draw latch according to the present invention.

As shown in FIG. 6, the pivot bosses 53, 54 preferably are provided with an angular configuration to facilitate installation of the pivot member 50 within the guide slots 31, 32 of the base 25. While not shown, the pivot bosses 61, 62 can also be angularly configured.

Figure 10:
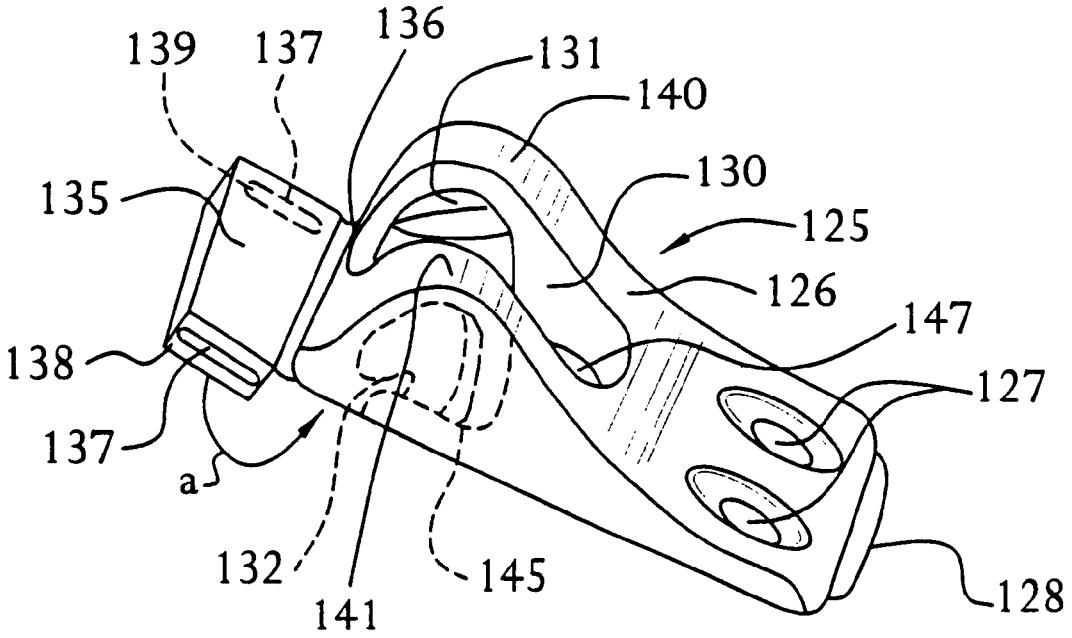
FIG. 10 is a parallel perspective view of an alternate embodiment of a base member according to the present invention.

Referring to FIG. 10, an alternate embodiment of a base member 125 is disclosed having a body portion 126 with apertures 127 disposed therein for mounting the base 125 to a closure panel. The base member 125 further includes a tab portion 128 which, as described above in relation to the tab portion 42 of the base 25 of FIG. 1, is received within a keeper member, such as that 20 described herein, when the latch 10 is closed. The base 125 includes a central opening 130 disposed therein. Receiving pockets 131, 132 are provided defining a recess for accommodating a pivot member and holding the pivot member in place. Preferably, while not shown, the pivot member can comprise a member such as the pivot member 50 described above. The pivot member is installed with its base mounting portion, such as that 52 provided on the pivot member 50 described above, being longitudinally inserted into the central opening 130 to protrude through the bottom opening 147 of the base 125. The pivot member is then rotated approximately 90 degrees so that each axial end of the base mounting portion is positioned within one of the receiving pockets 131, 132. The base 125 further includes a plug portion 135 which is then snapped into position below the pivot member to retain the base mounting portion within the base 125. The pivot member is pivotally maintained in relation to the base 125. The plug portion 135 is connected to the base 125 through hinging means, such as the living hinge 136. Connecting means are provided to connect the plug 135 to the base member 125. The connecting means are shown including a groove 137 disposed on a side wall 138 of the plug 135. The plug 135 is provided to be swingably moved in the direction of arrow "a", i.e. backfolded, to snap into engagement with the base member 125 and be connected thereto. This is done after a pivot member has been inserted to the base 125. The plug 135 facilitates retention of a pivot member within the base 125. The base 125 preferably is provided with a ridge 145 over which the recess 137 of the plug snaps and is held thereby when the plug 135 is snapped into the bottom of the base 125. Preferably the opposite wall 139 of the plug 135 also includes a recess 137. Similarly, the base 125 can be provided with a second ridge (not shown) which is received within the recess 137 of the opposite wall 139. The base 125 secures the pivot member (not shown) in place between the radial wall portions 140, 141 and the plug 135.

Figure 11:
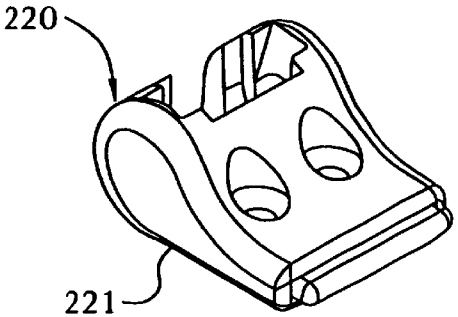
FIG. 11 is a parallel perspective view of an alternate base member embodiment for use with the draw latch shown in FIGS. 1–10, which is provided to operate with the other elements shown in FIGS. 1–10, but as a substitute for the base member the difference being the bottom surface.

An alternate pivot member 150 is shown in FIG. 11, having a central shaft portion 151 with stabilizing means shown including a spring portion 152 comprising at least a part thereof. The pivot member 150 further includes a base mounting portion 153 and a cover mounting portion 154. Aligning and orienting means is provided on the pivot member 150, shown comprising a first annular groove 155 disposed in the base mounting portion 153, and a second annular groove 156 disposed in the cover mounting portion 154. Pivot bosses 161, 162 provided on each axial end of the base mounting portion 153, and pivot bosses 163, 164 on each axial end of the cover mounting portion 154. These pivot bosses 161, 162, 163, 164 function as described above in connection with those 53, 54, 61, 62 of the pivot member 50 shown in FIGS. 1 through 5. The pivot member 150 provides flexibility in the lateral direction as indicated by arrows "b" and "c" in the event that the latch is inadvertently bumped or moved by a force other than that required for latching and unlatching. The spring 152 facilitates retention of the latch assembly by permitting deflections of the pivot member 150, and a cover attached thereto, when the draw latch assembly is inadvertently bumped, moved, or receives a force load other than from the directions associated with latching and unlatching of the latch.

Figure 12:
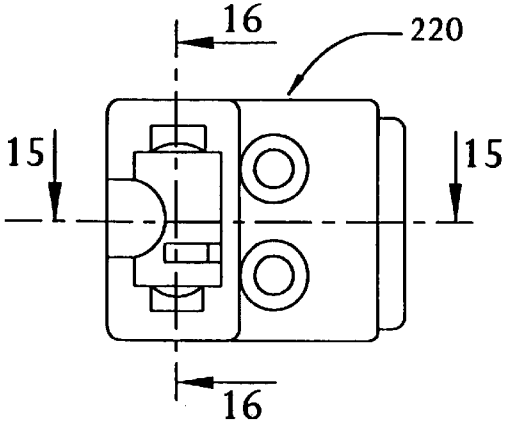
FIG. 12 is a top plan view of the base member of FIG. 11.

Referring to FIG. 12, an alternate embodiment of a pivot member 175 is shown comprising a pivot shaft 176 with a ball 177 at one end thereof and a socket 178 defined by a pair of arms 179, 180. While not shown, it is envisioned that a cover provided for use with this pivot member 175 will have a corresponding socket in which the ball 177 is received. The ball and socket connection between the pivot member 175 and a cover enables the cover to be freely rotated about the ball 177. Further the socket 178 can be attached to a base member, which, for example, may contain a transverse bar portion which fits through the arms 179, 180 of the socket 178 to retain the pivot member 175 on the base. It is further conceivable that one, or the other, of the cover and base member (while not shown), can contain a ball or socket, even though the pivot member 175 is described as having a ball for connection with a cover and a socket for connection with a base.

Figure 13:
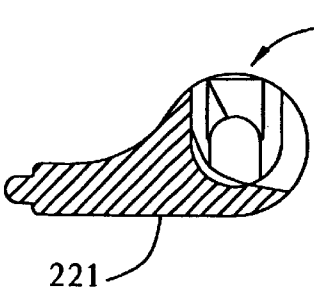
FIG. 13 is a longitudinal sectional view of the alternate base member of FIGS. 11 and 12, taken along the line 15—15 of FIG. 14.
Figure 14:
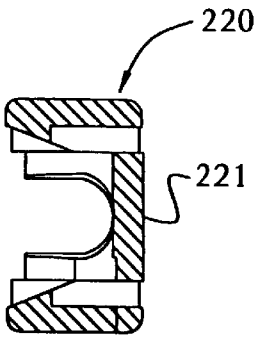
FIG. 14 is a transverse sectional view of the alternate base member embodiment of FIGS. 11–14 taken along the line 16—16 of FIG. 12.
Figure 15:
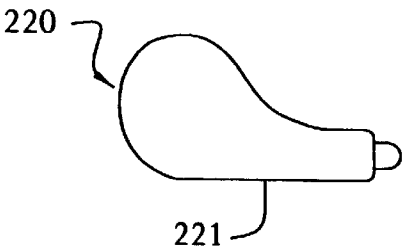
FIG. 15 is a left side elevation view of the alternate base member embodiment of FIGS. 11–14.
Figure 16:
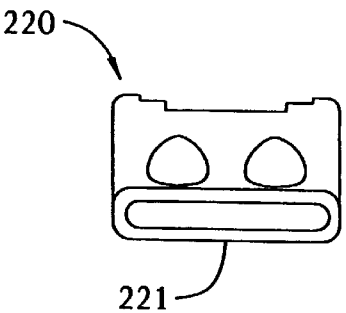
FIG. 16 is a front elevation view of the alternate base member embodiment of FIGS. 11–15.

FIGS. 13 through 18 disclose an alternate embodiment of a base member 220 according to the present invention for use with the pivot member and cover described herein. FIG. 13 is a parallel perspective view of the base member 220 shown having a bottom surface 221 which engages the surface of a panel to which the base member 220 is installed thereon. FIG. 14 is a top plan view of the base member 220 shown in FIG. 13. FIG. 15 is a sectional view of the base member 220 taken along the line 15—15 of FIG. 14. FIG. 16 is a transverse sectional view of the base member 220 taken along the line 16—16 of FIG. 14. FIG. 17 is a left side elevation view of the base member 220 shown in FIG. 13. FIG. 18 is a front elevation view of the base member shown in FIG. 13. The base member 220 shown in FIGS. 13 through 18 is provided to be mounted at any location on a panel surface to function in accordance with a pivot member, cover and keeper according to the present invention.

These and other advantages of the present invention can be made consistent with the spirit and scope of the invention as disclosed in the Summary of the Invention, the Brief Description of the Drawing Figures, and the Detailed Description of the Preferred Embodiments. While the above description constitutes the preferred embodiments of the present invention, it will be appreciated that the invention is subject to modification, variation and change, without departing from the proper scope or fair meaning of the present invention. In this regard, while the various features of the present invention have been shown and described in connection with a first closure member, such as a panel and a second closure member, also a panel, it will be understood that the invention can be used to secure sliding windows, doors, containers, enclosures, and other hinged, slidable or moveable members which are to be secured to one another.

What is claimed is:

1. A draw latch for securing a first closure member to a second closure member, the latch comprising:

a) a base member adapted for mounting to one of a first closure member and a second closure member; wherein said base member comprising aligning means for facilitating engagement with an edge of one or the other of a first closure member and a second closure member when the base member is mounted thereon; wherein said base member aligning means further comprises a first engaging element in the form of a transverse flange;

b) a cover member;

c) a pivot member having base connecting means for pivotally connecting said pivot member to said base, and cover connecting means for pivotally connecting said pivot member to said cover member; and d) a keeper member adapted for mounting to the other of a first closure member and a second closure member; wherein said keeper member has a second engaging element, whereby said first engaging element of said base member and said second engaging element of said keeper member being matingly configured for connection with each other to facilitate latching of said base with said keeper;

e) wherein said cover member has an end which is adapted for engagement with said keeper;

f) wherein said base has receiving means for connecting with said pivot member base connecting means, and wherein said cover has pivot connecting means for connecting with said pivot member cover connecting means;

g) wherein said base member receiving means comprises grooves which mate with said pivot member base connecting means; wherein said receiving means further comprises a pair of pivot apertures with a tapered guide slot leading to each said pivot aperture;

h) wherein said cover member pivot connecting means comprises grooves which mate with said pivot member cover connecting means; and i) wherein said pivot member base connecting means comprises a pair of pivot elements extending outwardly therefrom; wherein said pivot member has a central shaft portion with pivot elements disposed on one end thereof, said pivot elements comprising a pair of pivot bosses each of which extends outwardly from said shaft axis and in a direction opposite to the other; wherein said pivot elements each have an angular configuration for facilitating installation and retention on the base member; wherein said pivot member further comprises a first transverse shaft portion which is transversely disposed at an end of said central shaft portion to extend from opposite sides of said central shaft, and which first transverse shaft portion carries a said pivot boss at each shaft end thereof; wherein said cover member further comprises a rear wall with a notch disposed therein for accommodating the receipt of the central shaft therethrough to facilitate swinging of said cover member.

2. The draw latch of claim 1, further comprising first orienting means for orienting the connection of said pivot member to said base, said first orienting means comprising an annular groove disposed in said first transverse shaft at a location therealong, and a ridge disposed on said base member at a location corresponding to the location of said first transverse shaft annular groove when said pivot member is connected with said base.

3. The draw latch of claim 2, wherein said pivot elements each have an angular configuration for facilitating installation and retention on the base member.

4. The draw latch of claim 2, wherein said pivot member includes a second transverse shaft portion which is transversely disposed at an end of said central shaft portion opposite that of the first transverse shaft portion and which extends from opposite sides of said central shaft, and which second transverse shaft portion carries said pivot member cover connecting means at each axial end thereof.

5. The draw latch of claim 4, further comprising second orienting means for orienting the connection of said pivot member to said cover, said second orienting means comprising an annular groove disposed in said second transverse shaft at a location therealong, and a ridge disposed on said cover member at a location corresponding to the location of said second transverse shaft annular groove when said pivot member is connected with said cover member.

6. The draw latch of claim 4, wherein said pivot connecting means of the cover member comprises a pair of pivot apertures with a guide slot leading to each said pivot aperture.

7. The draw latch of claim 1, wherein said base member comprises a body with a first lower surface, and said base receiving means comprises a central opening in said body which is narrower in width than the width of said first transverse shaft, said central opening extending vertically though said body portion including through said first lower surface, said base further including a plug portion adapted to be selectively positionable to close said central opening in said first lower surface to secure said pivot member base connecting means.

8. The draw latch of claim 7, wherein said body has opposing upstanding wall portions which have recesses disposed therein for maintaining a said pivot boss therein.

9. The draw latch of claim 1, wherein said cover member has a rear wall with a notch disposed therein for accommodating the receipt of said central shaft therethrough to facilitate swinging of said cover member.

* * * * *

UNITED STATES PATENT AND TRADEMARK OFFICE

CERTIFICATE OF CORRECTION

PATENT NO. : 6,257,631 B1
DATED : July 10, 2001
INVENTOR(S) : Sokurenko et al.

It is certified that error appears in the above-identified patent and that said Letters Patent is hereby corrected as shown below:

Column 1,
Line 27, please delete "Frame et al." and replace with -- Bisbing --.
Line 29, please add "et al." after -- Rawson --.

Column 3,
Line 55, please delete "(".

Signed and Sealed this

Twenty-ninth Day of January, 2002

*Attest:*

*Attesting Officer*

JAMES E. ROGAN
*Director of the United States Patent and Trademark Office*